United States Patent [19]

Ginty et al.

[11] Patent Number: 4,901,552

[45] Date of Patent: Feb. 20, 1990

[54] APPARATUS AND A METHOD FOR FABRICATING SUPERPLASTICALLY FORMED STRUCTURES

[75] Inventors: Brian Ginty; Stephen H. Johnston; Duncan R. Finch, all of Balderstone, United Kingdom

[73] Assignee: British Aerospace PLC, London, United Kingdom

[21] Appl. No.: 306,467

[22] Filed: Feb. 6, 1989

[30] Foreign Application Priority Data

Feb. 6, 1988 [GB] United Kingdom ..... 8802738

[51] Int. Cl.[4] ..... B21D 26/02

[52] U.S. Cl. ..... 72/60; 72/54; 72/709; 29/421.1

[58] Field of Search ..... 72/60, 54, 709, 63, 72/61; 29/421.1

[56] References Cited

U.S. PATENT DOCUMENTS

| | | | |
|---|---|---|---|
| 2,728,317 | 12/1955 | Clevenger et al. | 72/60 |
| 3,340,101 | 9/1967 | Fields, Jr. et al. | 72/60 |
| 3,530,699 | 9/1970 | Uberbacher | 72/60 |
| 3,934,441 | 1/1976 | Hamilton et al. | 72/60 |
| 4,266,416 | 5/1981 | Festag et al. | 72/60 |
| 4,352,280 | 10/1982 | Ghosh | 72/60 |
| 4,409,808 | 10/1983 | Festag et al. | 72/60 |
| 4,516,419 | 5/1985 | Agrawal | 72/60 |
| 4,584,860 | 4/1986 | Leonard | 72/60 |
| 4,691,857 | 9/1987 | Friedman | 29/421.1 |
| 4,713,953 | 12/1987 | Yavari | 72/60 |
| 4,821,546 | 4/1989 | Story | 29/421.1 |

FOREIGN PATENT DOCUMENTS

| | | |
|---|---|---|
| 1480168 | 7/1977 | United Kingdom . |
| 1495655 | 12/1977 | United Kingdom . |
| 2100645 | 1/1983 | United Kingdom . |

*Primary Examiner*—David Jones

*Attorney, Agent, or Firm*—Kerkam, Stowell, Kondracki & Clarke

[57] ABSTRACT

A superplastic forming apparatus is described in which a blank of superplastic material is formed onto a die located in a pressure cavity. The die, which is preferably made of ceramic material, is removable from the cavity and requires no special connections for gas or vacuums ducts and therefore is cheap to manufacture. The use of a separate die also allows accurate monitoring and control of the pressure on the die side of the superplastic blank.

17 Claims, 2 Drawing Sheets

APPARATUS AND A METHOD FOR FABRICATING SUPERPLASTICALLY FORMED STRUCTURES

The invention relates to an apparatus and a method for forming structures from materials that are predominantly superplastic, that is to say materials that have superplastic properties and materials that, although not superplastic according to many definitions of the term, can undergo considerable elongation without fracture, e.g. metal composites such as titanium or aluminium containing silicon carbide particles, fibers or whiskers.

BACKGROUND OF THE INVENTION

Superplastic forming (SPF) is a manufacturing process ehich makes use of the characteristic of certain metals when heated and stretched to undergo elongation of several hundred percent without failure due to local necking.

SPF takes place at a temperature in the region of one-half the melting point of the metal. It is a relatively slow process, with typical elongation rates of 100% per hour. Titanium alloys, nickel alloys, and aluminium alloys and some stainless steels possess the necessary characteristics for superplastic forming.

The usual SPF process involves placing a sheet of the superplastic material in a die, heating the material to a temperature at which it exhibits superplasticity, and then using a gas to apply pressure to one side of the sheet. Sufficient pressure is applied to strain the material at a strain rate which is within the superplasticity range of the material being formed at the selected temperature. This gas pressure creates a tensile stress in the plane of the sheet which stretches the sheet and causes it to form into the die cavity.

A disadvantage of superplastic forming is the high cost of manufacturing dies, which are usually made of steel, since they must have accurately formed cover and die parts for perfect sealing to the blank and with optimally located inlet/outlet gas supply bores with the necessary unions for connection to external gas supply/exhaustion pipes. Also, separate dies are required for producing each component and the task of disconnecting one die and installing another into a superplastic forming apparatus is very time consuming. It is known from GB No. 1,495,655 and U.S. Pat. No. 4,584,860 to reduce the cost of manufacturing dies by making them from ceramic material but even so the cost of die production is still high because of the need to provide heating elements and gas supply ducts in the die. Also, the ceramic material cannot generally withstand the high pressures that are exerted in the superplastic forming process.

It is known to perform SPF in a special containment vessel that.can contain removable dies and this greatly reduces the cost of making the dies since it is not necessary to provide gas connection ducts in the die itself but rather such ducts are provided in the containment vessel and this makes the manufacture of the dies considerably less expensive. However the use of a removable die is not known in the technique of 'back pressure forming' described below and the use of such dies in back pressure forming provides advantages that are not apparent from their use in normal superplastic forming.

It is also known to perform simultaneous superplastic forming and diffusion bonding (SPF/DB) by compressing a mould in a hot platen press, i.e. a press having heatable platens. Heat from the platens heats the SPF/DB mould to the desired temperatures to perform SPF/DB; also, the press holds the mould parts together to withstand the pressure within the mould.

One undesirable characteristic of superplastic materials is their tendency to cavitate, i.e. to form small internal voids, during the tensile deformation imposed by the forming operation. A known method (known as 'back pressure forming') for overcoming this problem involves applying a pressure to both sides of the superplastic material or blank during forming. This reduces the magnitude of tensile stresses acting on the void nucleation sites, thus preventing the formation fo voids or decreasing their size and number. Known SPF apparatus, e.g. from U.S. Pat. No. 4,516,419, comprise two halves, between which a blank of forming material is sealably sandwiched. Each half of the mould has an inlet/outlet orifice through which an inert gas such as argon is passed under pressure. The blank of material is heated to a temperature at which it exhibits superplastic properties and gas pressure is applied simultaneously to both halves of the mould. After a suitable length of time th pressure in the lower half of the mould is reduced in accordance with a predetermined pressure/time variation and the excess pressure in the upper half of the mould forms the metal blank into the shape of the lower half of the mould. Alternatively, the pressure in the upper half of the mould can be increased in accordance with the predetermined prssure/time variation whilst the pressure in the lower half of the mould is held constant. This achieves the same effect. An example of this alternative method is described in U.K. Patent No. 2,100,645.

According to both these patents, the pressures on the respective sides of the superplastic sheet are controlled to provide the stress to form the sheet superplastically while avoiding formation and growth of voids or cavities in the structure of the blank as it is forming. These opposing forces cause relatively uniform thinning of the blank as well as alleviation of cavitation. The differential (or forming) pressure requires continual control and adjustment during the forming cycle and must reflect the physical characteristics of the material of the blank, the die shape and the forming temperature. In order to follow these pressure-time profiles accurately, valves controlling the input or exhaustion of gases to both sides of the metal blank must either be operated manually by a skilled operator or be controlled by a computer or micro-processor.

A further problem with the technique of back pressure forming is that towards the final moments of the forming process pressure fluctuations can occur inside the die which ruin the resulting formed product by causing it to ripple or buckle while it is still in a soft superplastic state. As the metal blank forms, it gets closer to the walls of the die and it may obstruct the inlet/outlet orifices of the die depending on their location. Where the die comprises a simple 'bowl' shape the orifice in the die side of the blank will conveniently be located in the very bottom of the die. If a blockage occurs it will cause a fluctuation in pressure inside the die which can damage the moulded article as it is formed. Damage can also occur during completion of a moulding due to the volume of gas remaining in the inlet/outlet pipes which may blow back as these are disconnected from the gas supply, causing localised distortions in the still soft component.

It is an object of this invention to provide a back pressure forming apparatus having provision for connection to a gas supply/exhaustion apparatus such that accurate control of the differential pressure/time profile is readily achievable.

It is a further object of this invention to provide a superplastic forming apparatus and a method which is effective to prevent possible damage to a superplastically formed article in a back pressure forming apparatus.

It is a further object of the present invention to reduce the tooling costs of the dies.

SUMMARY OF THE INVENTION

According to the present invention in one aspect thereof there is provided an apparatus for forming articles from predominantly superplastic materials, which apparatus comprises:

(1) a containment vessel having a container portion and a cover portion that between them form an enclosed cavity, the container portion and the cover portion being releasble to open the cavity;

(2) means for clamping a sheet or blank of predominantly superplastic material across the cavity between the container portion and the cover portion;

(3) a die that is removably located in the cavity of the container portion and that has an interior, an exterior and a bore extending between the interior and the exterior, (4) a space between the exterior of the die and the cavity wall, which space is in fluid communication via the bore with the interior of the die, (5) ducts for feeding gas into the cavity on respective sides of the blank and for exhausting gas from the cavity on respective sides of the blank for establishing a pressure differential across the blank between a first side of the blank adjacent to the container portion and a second side adjacent to the cover portion, the arrangement being such that the pressure on both sides of the blank during the forming operation is greater than atmospheric pressure but that that the pressure on the second side is greater than that on the first side.

(6) means to heat the containment vessel so that the cavity attains a temperature at which superplastic forming can take place.

The die, which may be made of male or female form, is preferably made of a material the interior of which may be readily formed and which is strong enough to withstand the differential pressure to be applied across the superplastic material during the forming process. A preferred material for the die is ceramic which may be cast in a wooden or plastic mould having a shape corresponding to the component to be formed. Because the die is totally surrounded by the pressure prevailing in the container portion of the cavity, the only force exerted on the die during superplastic forming are those resulting from the blank being urged against it, i.e. it is subjected to considerably reduced pressures as compared to known superplastic forming techniques and this permits the use of such ceramic materials commercially.

Preferably, the apparatus further includes support means for maintaining a clearance between a lower surface of the die and the container portion of the containment vessel. It is not necessary and indeed may not even be desirable for the bores of the die to be aligned with the ducts of the containment vessel when in use. Particularly when the die is made of ceramics or other brittle material, the support means for maintaining a clearance between the die and the container portion is preferably a porous material into which the die is bedded so that any uneveness between the die and the floor of the containment vessel cavity can be taken up by the bedding material without the die cracking under the forces exerted on the die during superplastic forming. The preferred bedding material is ceramic fiber blanket but any compactable material through which gas can diffuse may be used.

It will be readily appreciated that an apparatus according to the invention may be readily adapted to form components of differing and complex shape. This may be achieved by constructing an appropriate number of dies each having a separate one of a plurality of desired component configurations. In this way different components may be formed sequentially using the containment vessel without the necessity of disconnecting and reconnecting gas supply/exhaustion pipes to the dies after each forming operation. Moreover, the dies concerned are inexpensive and relatively simple to construct.

Alternatively, a number of components of differing shape may be formed simultaneously in the same containment vessel by inserting more than one die therein initially. After forming, the components may be separated by a simple machining operation.

It is preferred that the containment vessel has separate gas input and output orifices for both the cover portion and the container portion for the supply of gas to and the removal of gas from both sides of the blank to be formed so that the pressure on each side of the blank may be accurately controlled to follow a desired pressure differential-time profile. This may be done manually by means of valves located in the gas supply and gas exhaustion pipes connected in use to the containment vessel but is preferably controlled by a computer operating those valves in accordance with the predetermined pressure differential-time profile and the pressures monitored by sensors placed within the containment vessel gas ducts.

The provision of the bore(s) communicating between the interior and exterior of the die means that the pressure in the die is always equal to that in the container portion of the containment vessel and hence there is no possibility that if the superplastic material, as it is being formed, covers a bore in the die, a false reading will be given to the computer controlling the differential pressure applied across the material, even during the final stages of forming. Also, when the containment vessel is depressurized, the gas pressure on both sides of the formed material is suddenly reduced to atmospheric pressure but the volume of gas in a space surrounding the die acts as a buffer and ensures total evacuation of the die cavity and thus prevents distortion in the formed product.

The bores in the die may be of small diameter in order to minimise the distortion on the formed product by the bore, but the gas supply/exhaust ducts in the container portion of the cavity of the containment vessel are prferably relatively large in diameter since the designer will not have to give consideration to the possibility of the blank forming into them and thus distorting the final shape of the component being made. Large diameter ducts (a) enable speedier gas application to an removal of gas from the containment vessel, (b) are less likely to become obstructed, and (c) are readily connected to the associated gas management system.

By clamping the container portion and the cover portion of the vessel between platens of a hot platen press, the vessel can be made much more cheaply (a) because there is no need to provide heating elements inside the containment vessel because the vessel in the apparatus of the present invention is heated by the hot platen press and (b) because the top and bottom of the containment vessel need not be made as thick as the known containment vessel since these parts do not have to resist the pressures within the cavity during SPF since this pressure is contained by the press itself. Furthermore, a hot platen press is a piece of equipment that is often found in factories performing SPF since it is used in SPF/DB and thus there is a net saving in expense by using the apparatus of the present invention.

According to the present invention, in another aspect thereof there is provided a method of forming an article from predominantly superplastic materials, which method comprises:

(a) opening a containment vessel having a container portion and a cover portion that between them form an enclosed cavity, (b) placing into the container portion a die having an interior, an exterior and a bore extending between the said interior and the said exterior, the die being so dimensioned that there is a space between the exterior of the die and the cavity wall, which space is in fluid communication via the bore with the interior of the die, (c) clamping a blank of predominantly superplastic material across the cavity between the container portion and the cover portion, (d) heating the blank to a temperature at which the material of the blank exhibits superplastic properties, and establishing a pressure differential across the blank between a first side of the blank adjacent to the said container portion and a second side adjacent to the cover portion such that there is a positive pressure on both sides of the blank to avoid cavitation in the material but the pressure on the second side is greater than that on the first side, thereby urging the blank material into the die, (e) returning the pressure within the vessel to atmospheric pressure, and (f) opening the containment vessel, separating the formed article from the die and removing the article from the containment vessel.

It will be appreciated that the apparatus and method described above may be used to form components from superplastic forming materials other than titanium, e.g. certain aluminium alloys and certain steel alloys, and may also be applied to form materials such as metal matrix composites that, although they are not strictly speaking superplastic, nevertheless they are predominantly superplastic. Such predominantly superplastic materials can be formed using the back pressure technique described above, where the back pressures allows controlled stretching without necking or fracture; additinally a diaphragm of true superplastic material may be placed next to the blank of metal matrix composite to control the stretching of the blank.

An advantage of using separate inlet and outlet pipes to maintain gas pressure in the manner described above is that the hysteresis of the pressure control system is reduced and its sensitivity to changes in pressure increased as compared to the case in which pressure variations are attained by regulating the flow of gas through the same pipe because, in the latter case, time lags are introduced into the pressure control system whenever pressure variations inside the containment vessel are demanded.

BRIEF DESCRIPTION OF THE DRAWINGS

Specific embodiments of the invention will now be described by way of example only and with reference to the following drawings of which.

DETAILED DESCRIPTION OF PREFERRED EMBODIMENT

Figure 1:
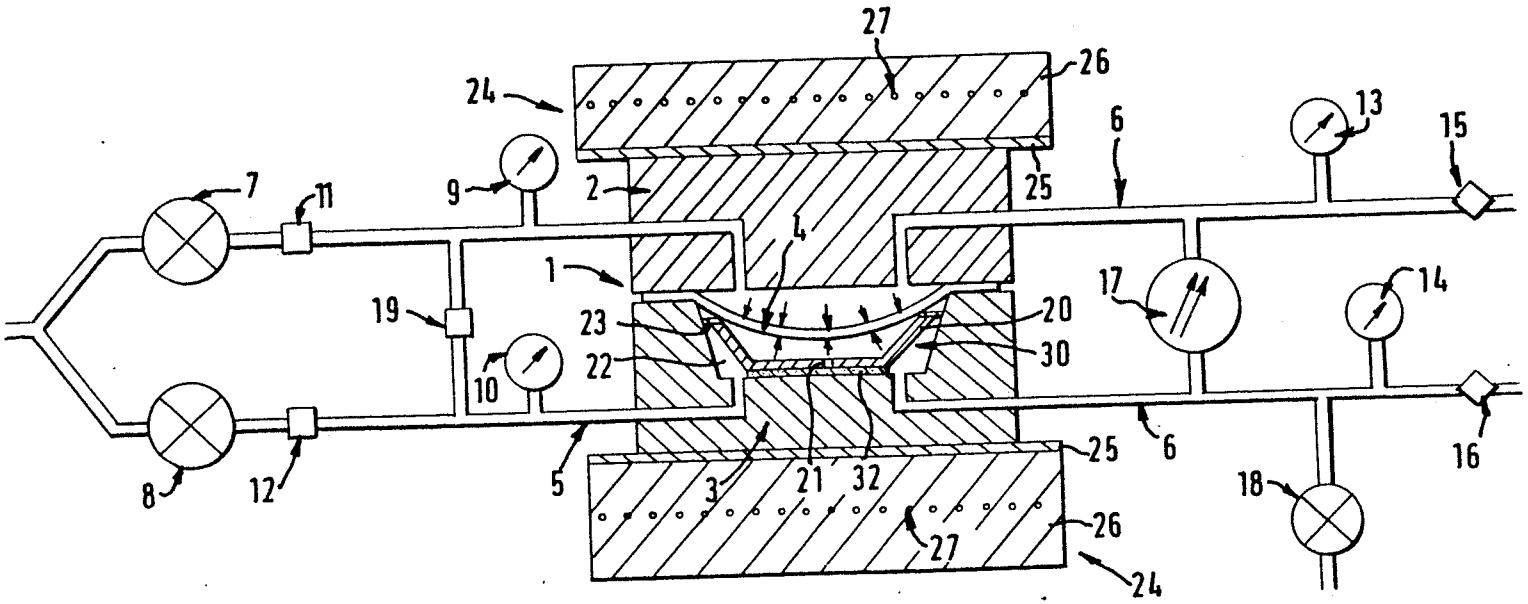
FIG. 1 is a schematic diagram of a back pressurising superplastic forming apparatus including a die.

In each of the drawings similar features have been given identical reference numerals.

Figure 2:
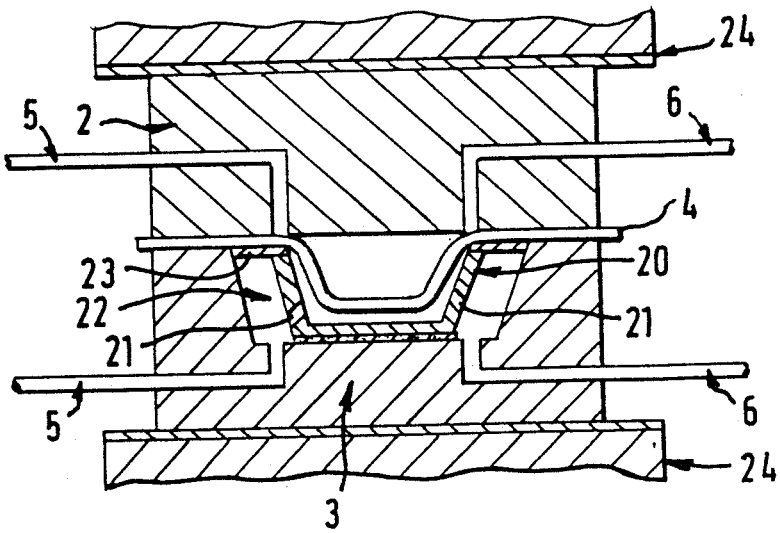
FIG. 2 is a schematic view of a detail of the apparatus shown in FIG. 1 but including a different die.
Figure 3:
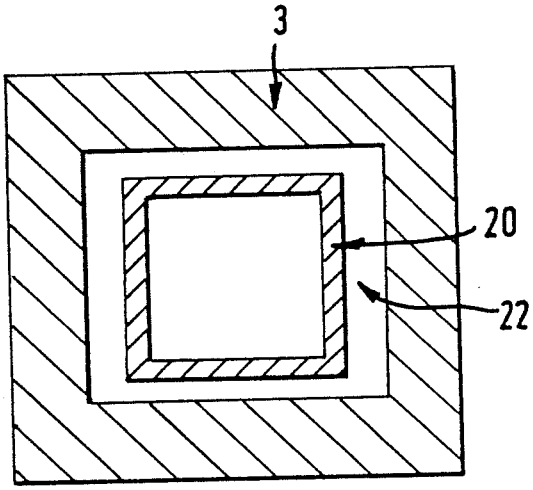
FIG. 3 is a plan view of the part shown in FIG. 2.

Referring to FIGS. 1 to 3, a superplastic back pressure forming apparatus is shown and comprises a containment vessel 1 which has an upper cover portion 2 and a lower container portion 3 defining between them an interior cavity 30. A superplastic metal sheet or blank 4 is shown positioned between the two portions and partially formed into the shape defined by a female ceramic die 20 located in the lower portion 3. There is a space 22 around the die 20 inside the cavity 30. The die 20 has one or more bores 21 through which gas can pass; in FIG. 1 a single bore is shown in the base off the die while in FIG. 2 two bore are illustrated in the sides of the die. The ceramic die is seated on soft porous packers 32, e.g. made of ceramic fiber blanket, which accommodate any unevenness between the ceramic and the base of the containment vessel and which prevent cracking of the ceramic under pressure.

To prevent material from entering into the space 22 between the die 20 and the wall of the containment vessel, a cover plate 23 is provide having a coefficient of thermal expansion similar to that of containment vessel 3.

The blank need not be made of superplastic materials but could for example be made of a non-superplastic (but still predominantly superplastic) formable material or metal matrix.

Each of the upper and lower portions 2 and 3 of the pressure vessel 1 has a gas inlet pipe 5 and a gas outlet pipe 6 respectively. The inlet pipes are connected to a source of pressurised gas (not ahown) via gas regulators 7 and 8 and have pressure gauges 9 and 10 and valves 11 and 12 connected to them. The outlet pipes 6 have pressure gauges 13 and 14 and valves 15 and 16 connected to them. A further pressure gauge 17 is connected between the two outlet pipes 6. One of the outlet pipes 6 has a valve 18 in it to regulate the overall back pressure inside the containment vessel. A separate bypass valve 19 is situated between the two inlet pipes 5.

The containment vessel is loaded into a hot platen press having heatable platens 24 composed of a steel plate 25 and a ceramic base 26; the ceramic base has heating elements 27 extending through it. The press then compresses the containment vessel to seal the cavity 30 and the platens are heated, thereby also heating the containment vessel so that the blank 4 attains a superplastic forming temperature.

The system shown is essentially manually operated, however, the gauges 9, 10, 13, 14 and 17 may be replaced by pressure sensors connected to a computer programmed to control the valves and regulators 7, 8, 11, 12, 15, 16, 18 and 19 to provide a predetermined differential pressure-time profile across the blank 4.

Initially an equal pressure of gas is applied to both portions of the containment vessel in order to compress the soft metal blank uniformly over its surface area and to resist cavitation in the known manner. Equal pressure is maintained by adjusting the flow of gas into and out of gas regulators 7 and 8, either manually or else automatically by computer. Pressurised gas is also supplied to the ceramic insert 20 through bore(s) 21. The pressure of the gas in both portions of the containment vessel is monitored (e.g. with pressure gauges or transducers) and is regulated by the use of the input and output valves 11, 12 and 15, 16 respectively. For example, if the pressure in the lower (container) portion of the containment vessel 3 is too low, pressurised gas is passed into the vessel through the inlet 5. Conversely, if the pressure in the lower (container) portion of the containment vessel 3 is too high gas is bled off through outlet 6. The pressure differential across the blank 4 is varied in accordance with a predetermined pressure/-time profile which deforms material at a known strain rate. At all times there is a positive pressure (hydrostatic) to both sides to prevent cavitation. The metal blank is formed into the ceramic die 20 while it is in a soft superplastic state by the higher prssure of the upper portion 2 of the containment vessel. The forming pressure across the metal blank is given by pressure gauge 17.

It will be noted that in the system illustrated the presence of the die 20 prevents the blank from closing off the inlet orifice 5 or the outlet orifice 6 during the final stages of forming. If the die 20 were not present, i.e. if the base of the cavity 30 forms the die as has been usual hitherto, the inlet orifice 5 or the outlet orifice 6 in the container portion 3 could be closed off by the blank 4 as it forms, causing a false pressure reading to be given by the gauge/transducer 13 or 14 and the manual/computer control system will generate an incorrect pressure adjustment which can damage the finished article by causing it to ripple or buckle.

An important feature of the invention is the space 22 between the ceramic die 20 and the lower portion 3 of the containment vessel 1 because this forms a reservoir of gas and effectively buffers the volume of gas inside the ceramic insert and thus protects the metal blank from pressure fluctuations. For instance, when the metal blank is nearing the end of the forming process and almost completely occupies the ceramic die 20, it may block off the bores 21. When this happens the pressure differential between the spaces above and below the metal blank will be maintained. This is because the space 22, which is at the same pressure as gas within the bores 21, effectively buffers and prevents sudden pressure changes due to the blockage. No damage occurs to the formed component in these final forming stages. Provided a sufficient number of bores 21 are provided in the ceramic die temporary blockages of one or more of the bores will not have any effect on the pressures monitored by the gauges/transducers and the desired differential pressure-time profile will be followed accurately. At room temperature, the die 20 could fit snugly into the cavity 30 so that it appears that there is no space 22 provided; however, the container portion 3 will generally be made from metal and the die from ceramics so that when the cavity has been heated to SPF temperature, the differential thermal expansion will open up a space 22.

When the blank has been formed into the shape of the die, the pressure in both portions of the containment vessel is reduced, the platen press is released so that the containment vessel can be opened and the formed article is removed.

Other embodiments are possible without departing from the scope of the invention. For example, the removable die need not be made of ceramic but could be made of other suitable materials. Ceramic was however found to be a good material because it is inexpensive, readily moulded to the shape of any desired component and also has good releasing properties which enable the formed object to be readily removed from the mould.

The bores 21 in the die are preferably provided in pairs and there should be at least one bore in each part of the die which will give rise to a depression or protrusion in the finished component isolated from other depressions or protrusions by 'lands' of material formed to a lesser or greater extent.

The use of removable dies in SPF and especially in back pressure forming process has the advantage that only one containment vessel is needed to produce many items of different shape sequentially using a set of appropriately shaped dies. It may also be possible to make two or more different or similar components in the containment vessel by inserting the appropriate number and type of ceramic dies. After each forming operation the pipe-work connected to the containment vessel can remain connected to the gas lines 5 and 6 thus reducing the time interval between the production of each component or set of components.

We claim:

1. An apparatus for forming articles from predominantly superplastic materials, which apparatus comprises:

(1) a containment vessel having a container portion and a cover portion that between them form an enclosed cavity, the container portion and the cover portion being releasable to open the cavity;

(2) means for clamping a sheet or blank of predominantly superplastic material across the cavity between the container portion and the cover portion;

(3) a die that is removably located in the cavity of the container portion and that has an interior, an exterior and a bore extending between the interior and the exterior, (4) a space between the exterior of the die and the cavity wall, whic space is in fluid communication via the bore with the interior of the die, (5) ducts for feeding gas into the cavity on respective sides of the blank and for exhausting gas from the cavity on respective sides of the blank for establishing a pressure differential across the blank between a first side of the blank adjacent to the container portion and a second side adjacent to the cover protion, the arrangement being such that the pressure on both sides of the blank during the forming operation is greater than atmospheric pressure but the pressure on the second side is greater than that on the first side (6) means to heat the blank to a temperature at which superplastic forming can take place.

2. An apparatus as claimed in claim 1, which includes means for sensing the pressure in the cavity and/or in gas ducts adjacent thereto on repsective sides of the blank.

3. An apparatus as claimed in claim 2, which includes a control system capable of receiving signals from the sensing means indicating the pressure in the cavity on respective sides of the blank and for controlling the pressure in the cavity on both sides of the blank in accordance with a predetermined pressure profile.

4. Apparatus as claimed in claim 1, wherein two or more dies are located in the cavity.

5. Apparatus as claimed in claim 1, wherein the die is supported on support means for maintaining a clearance between a lower surface of the die and a bottom surface of the cavity.

6. Apparatus as claimed in claim 5, wherein the support means is a bed of porous material.

7. Apparatus as claimed in claim 1, wherein the die is made of ceramics material.

8. Apparatus as claimed in claim 6, wherein the die is made of ceramics material.

9. Apparatus as claimed in claim 1, which includes inlet ducts for feeding gas into the cavity on respective sides of the blank and separate outlet ducts for exhausting gas from the cavity on respective sides of the blank.

10. Apparatus as claimed in claim 1, which includes a hot platen press having heatable platens for urging the container portion and the cover portion together to seal the cavity during forming and wherein the said heating means are constituted by the platens of the press.

11. A method of forming an article from predominantly superplastic materials, which method comprises:

(a) opening a containment vessel having a container portion and a cover portion that between them form an enclosed cavity, (b) placing into the container portion a die having an interior, an exterior and a bore extending between the said interior and the said exterior, the die being so dimensioned that there is a space between the exterior of the die and the cavity wall, which space is in fluid communication via the bore with the interior of the die, (c) clamping a blank of predominantly superplastic material across the cavity between the container portion and the cover portion, (d) heating the blank to a temperature at which the material of the blank exhibits superplastic properties, and establishing a pressure differential across the blank between a first side of the blank adjacent to the said container portion and a second side adjacent to the cover portion such that there is a positive pressure on both sides of the blank to avoid cavitation in the material but the pressure on the second side is greater than that on the first side, thereby urging the blank material into the die, (e) returning the pressure within the vessel to atmospheric pressure, and (f) opening the containment vessel, separating the formed article from the die and removing the article from the containment vessel.

12. A method as claimed in claim 11, wherein two or more dies are located in the cavity.

13. A method as claimed in claim 11, wherein the die is supported on support means for maintaining a clearance between a lower surface of the die and the container portion of the cavity.

14. A method as claimed in claim 12, wherein the support means is a bed of porous material.

15. A method as claimed in claim 11, wherein the die is made of ceramic material.

16. A method as claimed in claim 13, wherein the die is made of ceramic material.

17. A method as claimed in claim 11, which includes placing the containment vessel between the platens of a heated platen press and compressing the vessel between the platens to seal the cavity and wherein the vessel is heated by heating the platens of the press.

* * * * *

UNITED STATES PATENT AND TRADEMARK OFFICE

CERTIFICATE OF CORRECTION

PATENT NO. : 4,901,552

DATED : February 20, 1990

INVENTOR(S) : Brian GINTY; Stephen H. JOHNSTON; Duncan R. FINCH

It is certified that error appears in the above-identified patent and that said Letters Patent is hereby corrected as shown below:

Column 8, Claim 1, line 48, change "whic" to -- which --;

Column 8, Claim 1, line 56, change "protion" to -- portion --;

Column 8, Claim 2, line 65, change "repsective" to -- respective --;

Column 10, Claim 14, line 27, change "12" to -- 13 --.

Signed and Sealed this

Eighteenth Day of February, 1992

*Attest:*

HARRY F. MANBECK, JR.

*Attesting Officer*

*Commissioner of Patents and Trademarks*